United States Patent [19]

Cohan

[11] Patent Number: 4,580,783

[45] Date of Patent: Apr. 8, 1986

[54] PUZZLE COMPRISING OVERLAPPING CIRCLES WITH INTERCHANGEABLE COMPONENTS

[76] Inventor: Hooshang Cohan, P.O. Box 71, Claremont, Tasmania 7011, Australia

[21] Appl. No.: 664,000

[22] Filed: Oct. 23, 1984

Related U.S. Application Data

[63] Continuation-in-part of Ser. No. 530,581, Aug. 24, 1983, abandoned.

[51] Int. Cl.[4] ..... A63F 9/08

[52] U.S. Cl. ..... 273/153 S; 273/155

[58] Field of Search ..... 273/153 S, 155

[56] References Cited

FOREIGN PATENT DOCUMENTS

| | | | |
|---|---|---|---|
| 817717 | 10/1951 | Fed. Rep. of Germany | 273/153 S |
| 3143735 | 5/1983 | Fed. Rep. of Germany | 273/153 S |
| 387221 | 2/1933 | United Kingdom | 273/153 S |

*Primary Examiner*—Anton O. Oechsle
*Attorney, Agent, or Firm*—Larson and Taylor

[57] ABSTRACT

A puzzle having at least two overlapping circles disposed in a base, each circle being defined by a number of petals and a number of triangles. Each of the petals is formed of two arcs which are portions of a circle of the same circumference as each of the overlapping circles, and the triangles have faces in the form of arcs complementary to the arcs of the petals. The overlapping circles have common component petals and triangles, and rotation of either of the circles causes displacement of the common components. The petals and triangles have complementary tongues and grooves. The portion of the base underneath the circles has upwardly directed partial annular ridges, and the petals and triangles are provided with downwardly directed extensions which engage and are guided by the sides of the ridges.

3 Claims, 9 Drawing Figures

PUZZLE COMPRISING OVERLAPPING CIRCLES WITH INTERCHANGEABLE COMPONENTS

This application is a continuation-in-part of co-pending application Ser. No. 530,581, filed Aug. 24, 1983, now abandoned.

This invention relates to an improved puzzle and, particularly, to a puzzle which is basically two dimensional in form, as far as a user is concerned.

Over the last two to three years there has been a great resurgence in interest in puzzles and the phenomenal acceptance of the puzzle known as Rubik's cube is a good indication of this.

Whilst three dimensional puzzles certainly have a great attraction and interest, I believe that they suffer from certain disadvantages in that, unless a user has a highly developed spatial sense, it is often difficult to appreciate what the effects of certain changes in orientation of the faces will be.

For this reason, I believe that a puzzle which is basically two dimensional, that is one where the user can, at all times, see all the components of the puzzle, would be of great interest and it is to produce a puzzle of this type the object of the present invention lies.

Specifically, I propose a puzzle having at least two overlapping circles, each circle being defined by a number of petals and a number of triangles, each petal being formed of two arcs which are portions of a circle of the same circumference as the circle of the puzzle and having a chord equal to the radius of the circle, each triangle having faces each being an arc complementary to the arc of the petals, the arrangement being such that adjacent circles have common components which, by selective rotation of either or any of the circles, can cause spatial displacement of the common components.

Such a puzzle has been proposed in German Gebrauchsmuster No. G 81 23 478.3 of Professor Dr. Max J. Kobbert, and I refer specifically to FIG. 3 of the specification of that Gebrauchsmuster.

Whilst, in a broad sense, this Figure proposes the type of puzzle in which I am interested, it does not appreciate the physical difficulties in causing such a puzzle to operate.

In order for the components of the puzzle to move closely, one relative to the other, the components have to be made at a high tolerance although, it will be appreciated that a circumference of a circle is not precisely defined by six radial arcs. Thus, whilst prima facie the concept of FIG. 3 of the Gebrauchsmuster can provide a puzzle, I have found that, practically, such a puzzle would not operate as the components would either stick or jam as they move past each other.

In my invention, the petals and triangles have complementary tongues and grooves and the circles comprising the puzzles are located in a base which has a peripheral tongue or groove complementary to that of the adjacent petals, the floor of the base having upstanding ridges in the form of arcs of circles concentric to the circles of the puzzle and each petal and each triangle having at least one downward extension which is adapted to cooperate with and be guided by the ridges over a substantial part of its movement, whereby the components are constrained to move in fixed paths, one relative to the other.

Preferably the ends of at least the petals are radiused at a radius different to that of the two arcs which form the petals so that they present a curved surface when in contact with ends of other components.

In a preferred form of the invention I may provide the components of a synthetic plastics material and a body member which may be separable so that, on assembly, there is provided a hand held puzzle, the upper face of which demonstrates the features of the puzzle, and which can be readily manipulated by a user's hands.

In order that the invention may be more readily understood, I shall describe the invention in relation to the accompanying drawings; in which.

Figure 2:
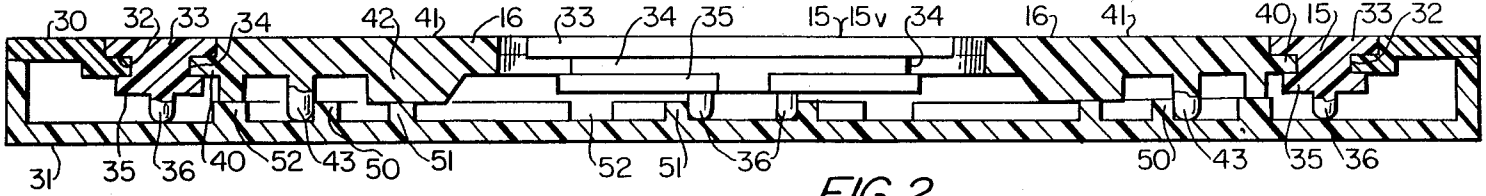
FIG. 2 is a section along line 2—2 of FIG. 1 showing the overall construction of the base and the petals and triangles.
Figure 5:
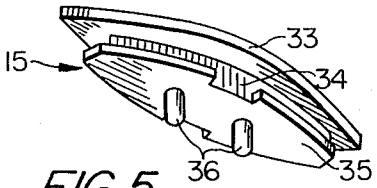
FIG. 5 is an underneath perspective view of a petal.
Figure 6:
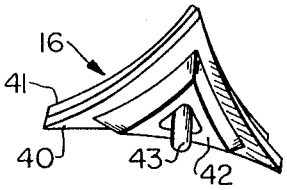
FIG. 6 is a similar underneath perspective view of a triangle.
Figure 1:
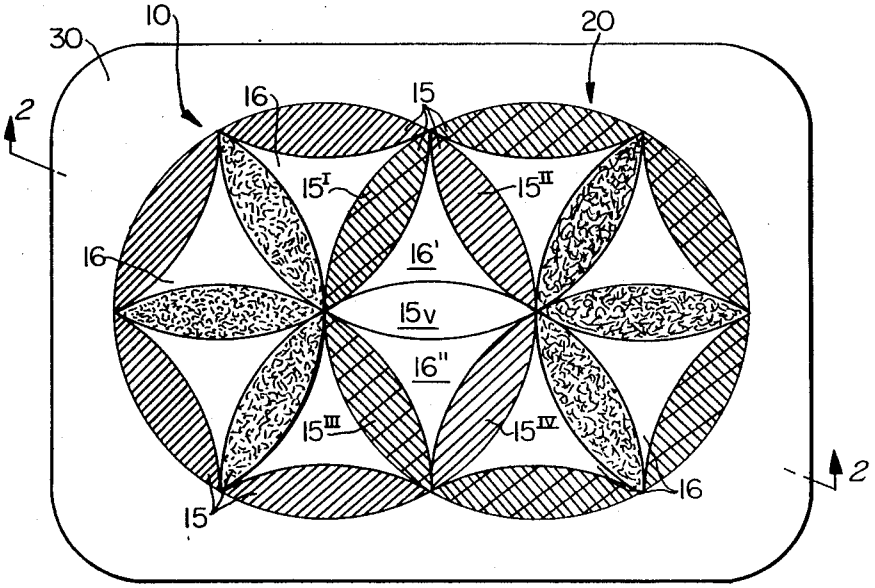
FIG. 1 is a top plan view of an assembled puzzle consisting of two inter-locking circles.
Figure 3:
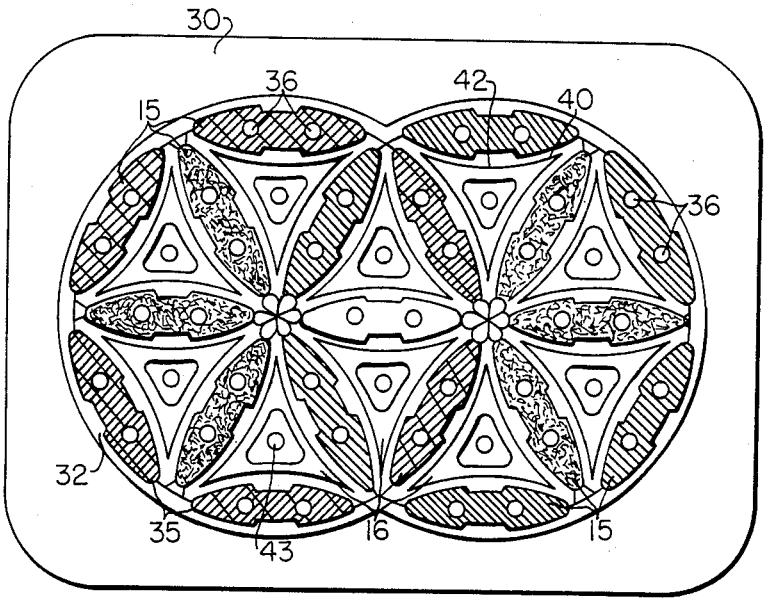
FIG. 3 is an underneath view of the puzzle with the base removed.

I shall refer firstly to the embodiment of FIGS. 1 to 6 and, more specifically, to the general concept of the invention which is best illustrated in FIG. 1.

It can be seen there are, effectively, two overlapping circles 10 and 20, each of which can be considered as having six peripheral petals, petals generally being indicated at 15, and six radial petals, the petals of each circle enclosing six triangles, indicated generally at 16.

It will be noted that five petals $\mathbf{15}^{i}$ to $\mathbf{15}^{v}$ and two triangles $\mathbf{16}^{i}$ and $\mathbf{16}^{ii}$ are common to the two circles, the petals $\mathbf{15}^{ii}$ and $\mathbf{15}^{iv}$ being peripheral petals of the left circles and the other three being radial petals and petals $\mathbf{15}^{i}$ and $\mathbf{15}^{iii}$ being peripheral petals of the right circle and the other three being radial petals.

As can readily be visualised, provided each of the components are capable of movement, one relative to the other, it would be readily possible to rotate, as a whole, one or other of the circles which rotation will cause the displacement of the common components so that they will be partially or completely removed from the common position and if then the same circle or, more particularly, the other circle is then partially rotated, so there can readily be a random mixing of the various components.

Provided then the original selection of colours of the various components is such as to provide an organised pattern, the puzzle provides the possibility of disturbing this organisation, which is simply done by random movement of the two circles, and then permits an attempt to reconstruct the original organisation or, alternatively, the possibility of starting from an initial, organised, situation and to transpose various parts of the organisation. For example, as illustrated in FIG. 1, schematically I have shown the peripheral petals of the two circles as being of one colour, the radial petals, which are not common petals, as being of a second colour, although it may be preferred that the three such radial petals of one circle are all of a different colour to the equivalent petals of the other circle and the central common petal, petal $\mathbf{15}^{iv}$, may be of a different colour or a neutral colour. Similarly, whilst the various triangles 16 are shown as being uncoloured, it would be possible for the uncommon triangles, that is the four triangles outwardly of the common petals, in each case, to be of the same or two different colours and of a colour or colours different to the common petals and it would be possible to effect transposition of these.

In this specification it is not proposed to provide specific instructions for any transposition of components or a general principle to return the components to the original organised position.

Referring now to FIGS. 1 to 6 as they specifically illustrate one practical form of the invention, the invention can be considered to be illustrated as, effectively, full size in FIG. 1, although this is only exemplary, and is made from a face component 30, a base 31, nineteen petals 15 and ten triangles 16.

The various components may be moulded from a synthetic thermoplastics material and, preferably, a material which has good dimensional stability, as accuracy of formation is critical, and, also, which shows low friction properties where two components are in abutment or, alternatively, which is capable of being lubricated to give such properties.

I have found one suitable material for this to be high impact polystyrene and, if required, to aid the required frictional properties, the moulding powder may have incorporated a percentage of talc or of silicone.

The properties of various thermoplastics and methods of handling these are known in the art and will not be discussed further herein.

The face 30 is provided with a peripheral tongue 32 which extends fully around an aperture formed therein and which is spaced below the upper surface of the face by a distance equal to the thickness of the face member 33 of a petal 15.

Each petal has, below its face member 33, a groove 34 which is defined, on its lower edge, by a lower member 35, the arrangement being such that, when a petal is engaged with the peripheral tongue 32, the upper surface of the face 33 is at the same level as the upper surface of the face 30, the tongue 32 enters the groove 34 and transverse outward movement is restricted by the lower member 35.

Each triangle 16 is formed with a peripheral tongue 40 which is spaced below the triangle's face 41 by a distance equal to the thickness of the face member 33 of the petal so that, on interengagement of the triangle with the petal, so the upper surfaces of their face members lie in the same plane. Thus, when the total required number of petals and triangles are assembled into the aperture of a face member 30, the upper surface of the assembled body is effectively co-planar, as can be seen from the upper surface of FIG. 2, and the outer appearance is then, of course, as illustrated in FIG. 1.

It will be seen that the lower member 35 of each petal is smaller than the face member 33 so that this does not, in any way, obstruct movement of the petal vis-a-vis the triangles and it will also be seen that each triangle has a lower portion 42 which is also smaller than the main body of the triangle so as not, in any way, to obstruct movement of the triangle.

Whilst it might be though that the construction so far described, with the petals and triangles located relative to the tongues 32 would give the required control of movement of the components, I found that this is not, in fact, the case.

With a construction of the type described, where triangles 16 met, and where there was to be relative movement between the components, such as at the centre of a circle some of the components of which are fixed when the other circle is being rotated, the ends of the triangles tended to jam and the assembly would lock and could be difficult to again rotate.

In order to overcome this disadvantage, and the disadvantage was sufficient to make the puzzle commercially impractical, I adopted two different complementary approaches.

In the first of these I provided ridges 50, 51 on the floor of the base, which ridges extended upwardly therefrom and which are in the form of arcs of circles, the centres of which are the centre of the circle of the puzzle.

It will be seen that these ridges 50, 51 are not continuous in that there are two arcuate grooves, shown at 52, which, again, are arcs of the circles of the puzzle and, also, the outer ridges are broken at their points of intersection at the centre of the puzzle.

The downward extension 42 of the triangles 16 and the downward extension 35 of the petals 15 are such a depth that their undersides contact the ridges 50, 51 in the base and thus the overall upper surface of the puzzle is maintained.

Also, in this way, because the area is contact is relatively restricted, there is a minimisation of friction between the components.

More importantly, each triangle has a downwardly extending stem 43 which extends below the surface of the portion 42 and which abuts the outer edge of the ridge 50 and, thus, movement of the triangles is constrained by the location of these ridges and the relative orientation of the various components are also restrained.

Each petal is also provided with a pair of extensions 36 and, where the petals are radial, one of the extensions 36 abuts the outer surface of ridges 51 and the other an adjacent ridge to guide the petals in their movement and thus, again, to restrain these to move in the required manner.

Figure 4:
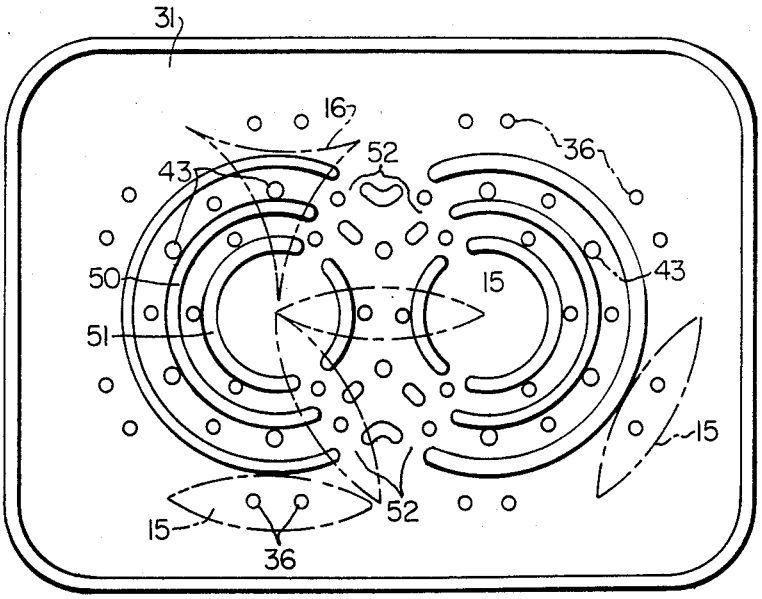
FIG. 4 is a plan view of the base of the puzzle with the upper portion removed.

FIG. 4 shows the orientation of the stems 43 and 36 in the base. Certain of the petals 15 and a triangle 16 are shown in this figure in chain dash lines to show the orientation of the components and the effective guiding by ridges 50 and 51.

Two arcuate grooves 52 are shown through the ridges 50, 51 and the external ridge in the base, which grooves permit the mounting of the peripheral petals in the common area. This can well be seen from examination of FIG. 4.

The second approach is that at least of the petals is formed so that its ends, at the upper surface, are not formed by the intersection of two arcs but, rather, are radiused so that, where a number of petals are in close proximity, such as at the centres of the circles and the two central outer junctions where four petals terminate at a point, the ends of the petals tend not to jam one with the other if there is any misalignment of the petals and an attempt is made to move one circle relative to the other.

I found that, where the petals were more truly formed and there was misalignment, and in this respect I refer to my earlier comments about the fact that the components do not fit exactly into circles, then the puzzle could lock and it could be impossible to move this.

The radiusing of the petals, together with the restraint described earlier herein, minimises the effect of any such misalignment.

When the various components are assembled into the face member 30, the face member is located over the base 31 and the two members are held together either by gluing, ultrasonic welding or by any known method of connecting plastics components.

It will be appreciated that, in the assembled condition, the movement of the petals and triangles is constrained by the tongue and groove contact between the components themselves and between the circumferential petals and the peripheral 32 which extends around the aperture and, also, by the guidance of the stems 43 of the triangles and the extensions 36 of the petals acting against the ridges 50, 51 and, in this way, the whole arrangement can be constrained to move without any rocking of the components.

The finished contruction is, in fact, able to move smoothly and accurately and thus permits a person manipulating the puzzle to cause the components to interengage effectively and well.

Although not illustrated, register springs may be provided to co-operate with the petals so that, on relative rotation of the two circular components on each required degree of rotation, that is after every 60° of rotation, the components will be positively located and the required orientation maintained.

Thus, if a user is to alternately rotate one circle to a stop and then the other similarly so the components will be in the correct orientation on each movement.

Figure 7:
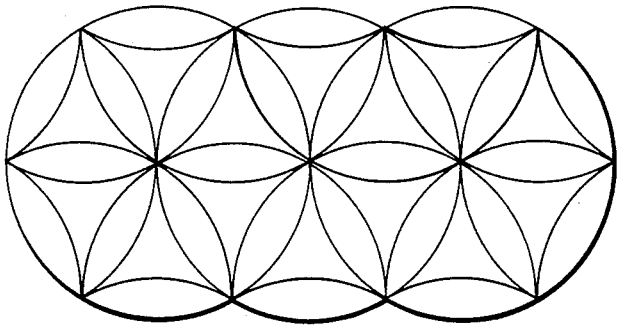
FIGS. 7, 8 and 9 are schematic views showing how the concept of the invention can extend to a number of inter-locking circles which, themselves, can be in an arrangement which is aesthetically pleasing and which is adapted for use in a number of different applications.
Figure 8:
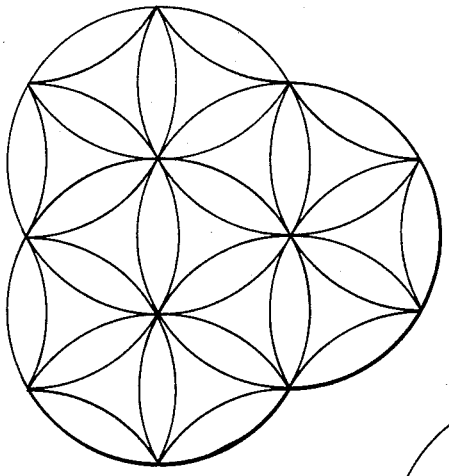
Figure 9:
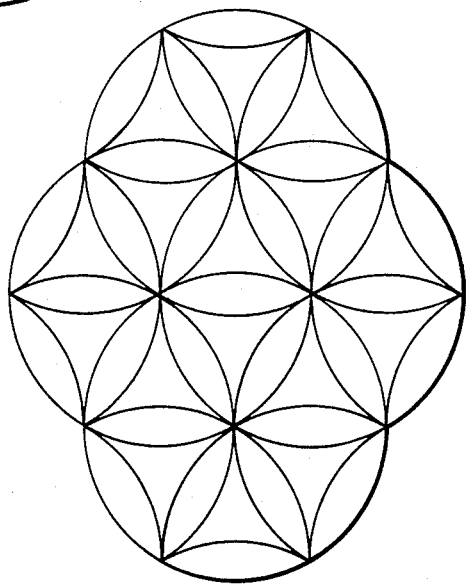

The embodiments of FIGS. 7 to 9 show that the invention can be readily applied to a large variety of different combinations of circles and, reference to FIGS. 7 and 8 specifically, will show the two ways in which three circles can be combined, FIG. 7 being where the centres of all three circles lie in a straight line and FIG. 8 shows an arrangement where such centres lie at the corner of an equilateral triangle.

FIG. 9 shows an arrangement of four circles where the centres are at the corners of a diamond having its shorter axis one radius of the circle and its longer axis the length of a chord having an arc comprised of the arcs of two petals.

It will be seen that by increasing the number of circles, so the orientation and complexity of the puzzle of the invention can be widely varied.

It will also be appreciated that, whilst the embodiment of FIGS. 1 to 6 shows a particular constructional arrangement which is suitable for a hand held puzzle, there can be wide variation in the construction without departing from the concept of the invention.

I claim:

1. A puzzle having at least two overlapping circles, each circle being defined by a number of petals and a number of triangles, each petal being formed of two arcs which are portions of a circle of the same circumference as the circle, each triangle having faces each being an arc complementary to the arc of the petals, the arrangement being such that adjacent circles have common components which, by selective rotation of either or any of the circles, can cause spatial displacement of the common components, the petals and triangles having complementary tongues and grooves, and the circles comprising the puzzle are located in a base which has a peripheral tongue or groove complementary to that of the adjacent petals, the lower base member has at least one upwardly directed partial annular ridge associated with each circle, each triangle has a downwardly depending extension adapted to abut and be guided by one side of the ridge over a substantial part of its rotation, and each petal has two downwardly depending extensions, symmetrically located thereon, each of said extensions being adapted to be guided by one side of the ridges over a substantial part of its rotation, the spacing between the extensions being equivalent to the spacing between the associated upwardly directed annular ridges of the adjacent circles.

2. A puzzle as claimed in claim 1 wherein there are two partial annular ridges around each circle and wherein the spacing between these two ridges is equal to the spacing between the downwardly depending extension of the petals whereby the movement of the petals is guided by the ridges.

3. A puzzle as claimed in claim 1 wherein the petals and triangles are of a synthetic plastics material and the base comprises two members which may be separable, the peripheral tongue or groove being in the upper member, so that, on assembly, there is provided a hand held puzzle, the upper face of which demonstrates the features of the puzzle and which can be readily manipulated by a user's hands.

* * * * *